US008387631B1

(12) United States Patent
Thonghara et al.

(10) Patent No.: US 8,387,631 B1
(45) Date of Patent: Mar. 5, 2013

(54) HDA VACUUM CLEANING MACHINE FOR MANUFACTURING OF HDD

(75) Inventors: Pranee Thonghara, Phatumtani (TH); Lie Dhani Hastama, Petaling Jaya (MY); Pattira Mokawan, Trang (TH)

(73) Assignee: Western Digital Technologies, Inc., Irvine, CA (US)

( * ) Notice: Subject to any disclaimer, the term of this patent is extended or adjusted under 35 U.S.C. 154(b) by 677 days.

(21) Appl. No.: 12/332,029

(22) Filed: Dec. 10, 2008

(51) Int. Cl.
*B08B 5/02* (2006.01)

(52) U.S. Cl. ..... 134/104.2; 134/94.1; 134/166 R; 15/300.1; 15/345; 15/346

(58) Field of Classification Search ..... None
See application file for complete search history.

(56) References Cited

U.S. PATENT DOCUMENTS

| | | | | |
|---|---|---|---|---|
| 4,245,437 | A | 1/1981 | Marton | |
| 5,177,833 | A * | 1/1993 | Brodsky | 15/310 |
| 6,187,106 | B1 | 2/2001 | Backlund et al. | |
| 6,231,676 | B1 | 5/2001 | Rudd et al. | |
| 6,402,853 | B1 * | 6/2002 | Carlisle | 134/6 |
| 6,418,818 | B1 | 7/2002 | Tham et al. | |
| 6,689,225 | B2 * | 2/2004 | Illingworth | 134/21 |
| 7,124,466 | B2 | 10/2006 | Dinsmore | |
| 7,178,432 | B1 | 2/2007 | Han et al. | |
| 2001/0050831 | A1 | 12/2001 | Olim | |
| 2002/0020837 | A1 | 2/2002 | Sherwin | |
| 2004/0159340 | A1 * | 8/2004 | Hiatt et al. | 134/26 |
| 2009/0229639 | A1 * | 9/2009 | Metzner et al. | 134/32 |

* cited by examiner

*Primary Examiner* — Michael Kornakov
*Assistant Examiner* — Ryan Coleman

(57) ABSTRACT

A machine for cleaning a head-disk assembly (HDA) of a hard disk drive (HDD) includes a nest that seals the HDA between an upper and lower portion during cleaning. An inlet port receives a gas and an exhaust port exhausts the gas and entrained particles. A shock drive delivers mechanical shocks to the nest and the HDA while the gas is flowing through the HDA. A blower may circulate the gas from the exhaust port to the inlet port. A filter may be coupled to the inlet port. The HDA nest may be movable along an axis of the mechanical shocks delivered by the shock drive. A blow tube may deliver gas to a screw hole and a coaxial vacuum tube may rest against a surface around the screw hole to encapsulate the blow tube during cleaning and remove the gas and particles from the screw hole.

19 Claims, 4 Drawing Sheets

HDA VACUUM CLEANING MACHINE FOR MANUFACTURING OF HDD

BACKGROUND

A hard disk drive (HDD) stores information by digitally encoding the data on rapidly rotating platters with magnetic surfaces. The HDD includes read/write heads and a servo head that are mounted on the end of a rotary arm actuator. When the disk unit is turned off, these heads are loaded onto plastic "ramps" near the outer disk edge. When the disk unit is turned on and the drive motor spins the disk platters to a high speed, air pressure, and the aerodynamic characteristics of the head design, cause an air-bearing to form which causes the heads to take off from the disk surface and "fly." When the disk heads are flying, they are unloaded from the ramps and moved over the area on the disk platters containing data. The head assemblies are designed such that between the air-bearing force that tries to lift the heads and the spring force that causes them to land on power-off, they fly at approximately 19 microinches (0.48 microns) above the disk surface.

The interior of the cavity is designed such that the rotation of the disk platters causes high- and low-pressure areas. The resulting circulating air flow is directed through a 0.3 micron absolute filter within the sealed cavity. Thus, the air within the cavity is being continually filtered. Another 0.3 micron absolute filter on the bottom cover is used to allow the cavity pressure to equalize with the outside ambient pressure.

If a particle of dirt passes under a flying head it can disrupt the air bearing and cause the head to "crash" onto the surface of the spinning disk platter. A head crash will generally cause a catastrophic failure of the HDD. Therefore it is necessary that the heads and disks be sealed in a clean cavity free of particles. To achieve this, a HDD is constructed with a head-disk assembly (HDA) that is sealed with a cover in a clean-room to provide a clean cavity within the HDD that safely houses the heads and disk platters. The HDA is cleaned before being sealed to remove particles, particularly those larger than 0.5 microns in size. The cleaning may be done by a manual vacuuming process, which is time consuming and inconsistent in terms of particle removal.

It would be desirable to provide a cleaning machine to automate the HDA cleaning process and improve the removal of particles.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
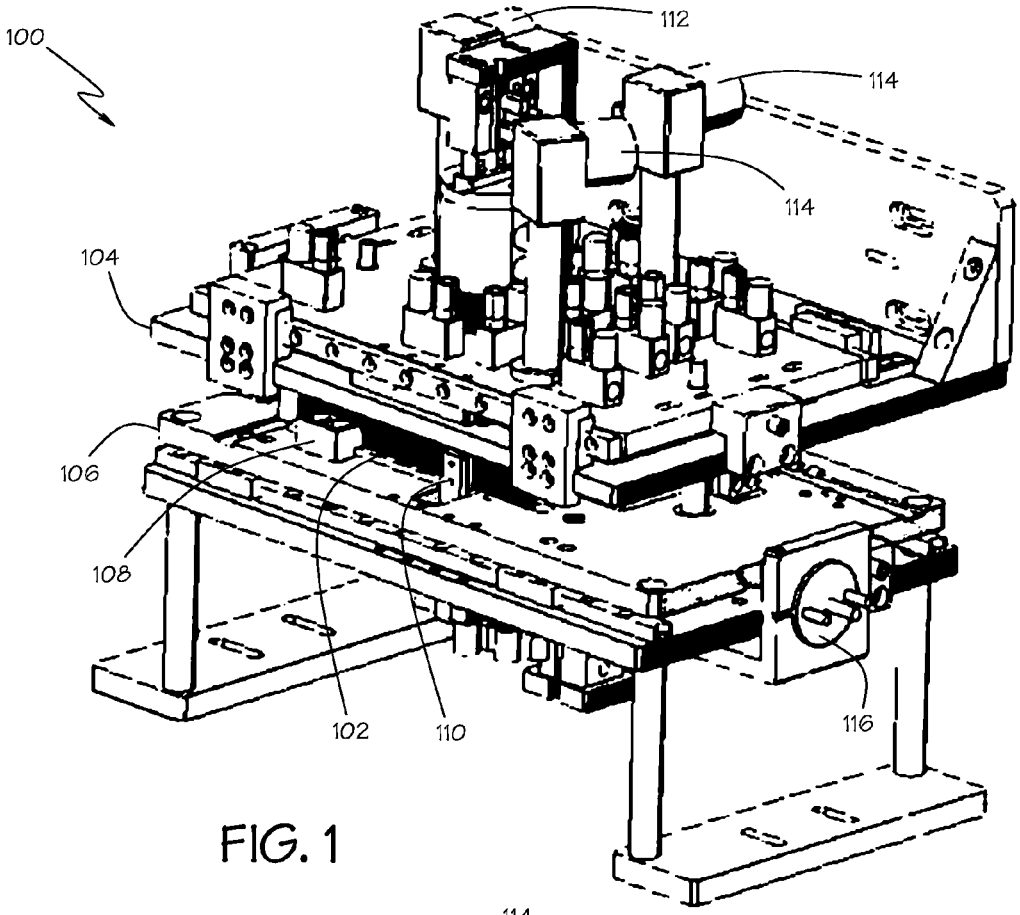
FIG. 1 is a pictorial view of a machine for cleaning a head-disk assembly (HDA) of a hard disk drive (HDD).
Figure 2:
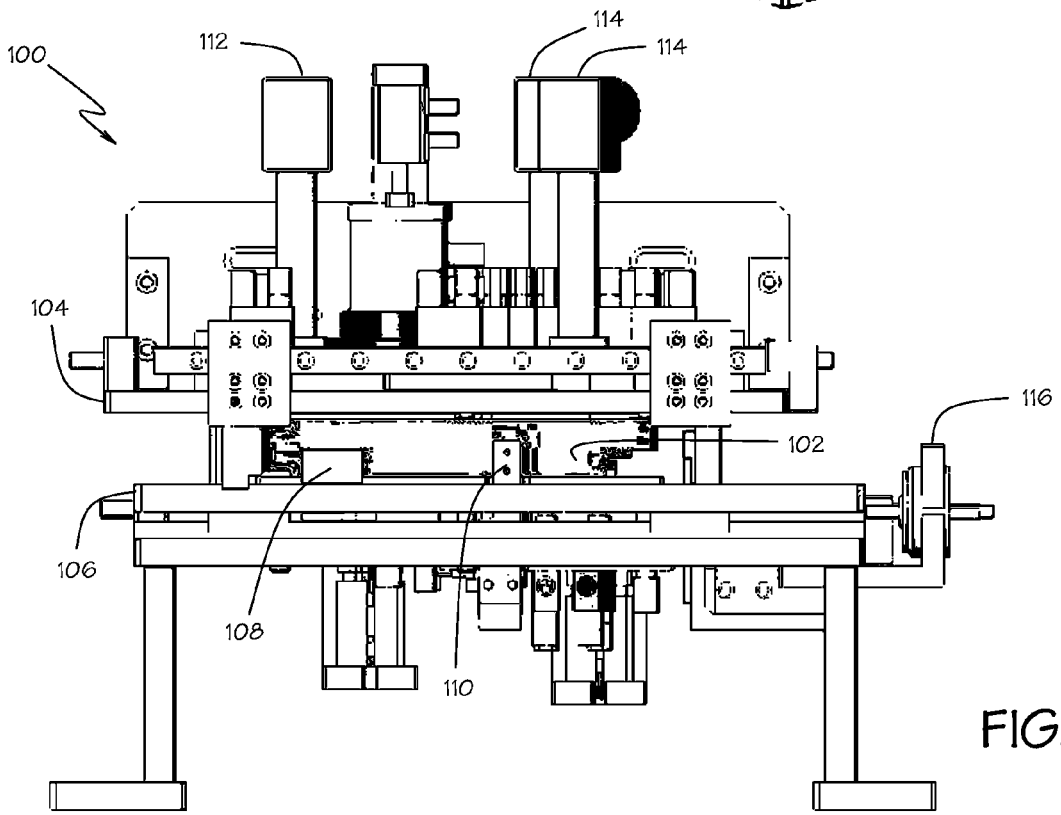
FIG. 2 is a side elevation of the machine shown in FIG. 1.
Figure 4:
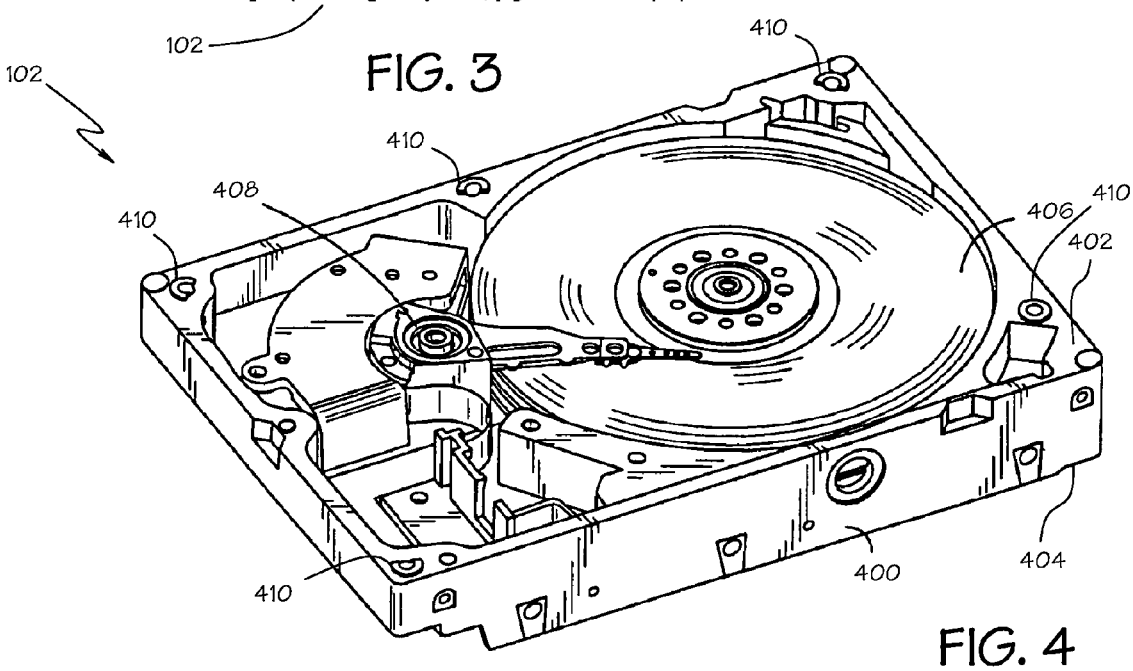
FIG. 4 is a pictorial view of an HDA.

FIGS. 1 and 2 show an exemplary machine 100 for cleaning a head-disk assembly (HDA) 102 of a hard disk drive (HDD). FIG. 4 shows an exemplary HDA 102 that may be cleaned by the machine 100. The HDA includes a frame 400 that has closed side walls but is largely open on at least one of its top 402 and bottom 404 sides. The frame supports a rotating disk stack 406 and a moving head assembly 408. The top 402 and/or bottom 404 sides of the frame 400 are closed by cover plates (not shown) to provide a sealed enclosure for the disk stack 406 and the head assembly 408. The cleaning machine 100 cleans contaminants from the HDA 102 before it is closed by the cover plates.

The machine 100 includes an HDA nest having an upper portion 104 and a lower portion 106. Guides 108 and clamps 110 may locate and secure the frame 400 of the HDA 102 in the nest 104, 106. The upper portion 104 and lower portion 106 of the nest are drawn together to seal the open top 402 and bottom 404 sides of the HDA 102, temporarily providing a sealed enclosure for the HDA. The HDA nest may include resilient seals, such as polyurethane seals, to provide a gas tight seal between the frame 400 and the nest 104, 106.

One or more inlet ports 112 are coupled to the HDA nest 104, 106 to receive a gas, such as air or nitrogen. One or more exhaust ports 114 are coupled to the HDA nest 104, 106 to exhaust the gas and entrained particles. It will be appreciated that the inlet ports 112 and exhaust ports 114 may be in either or both of the upper portion 104 and lower portion 106 of the nest.

Figure 3:
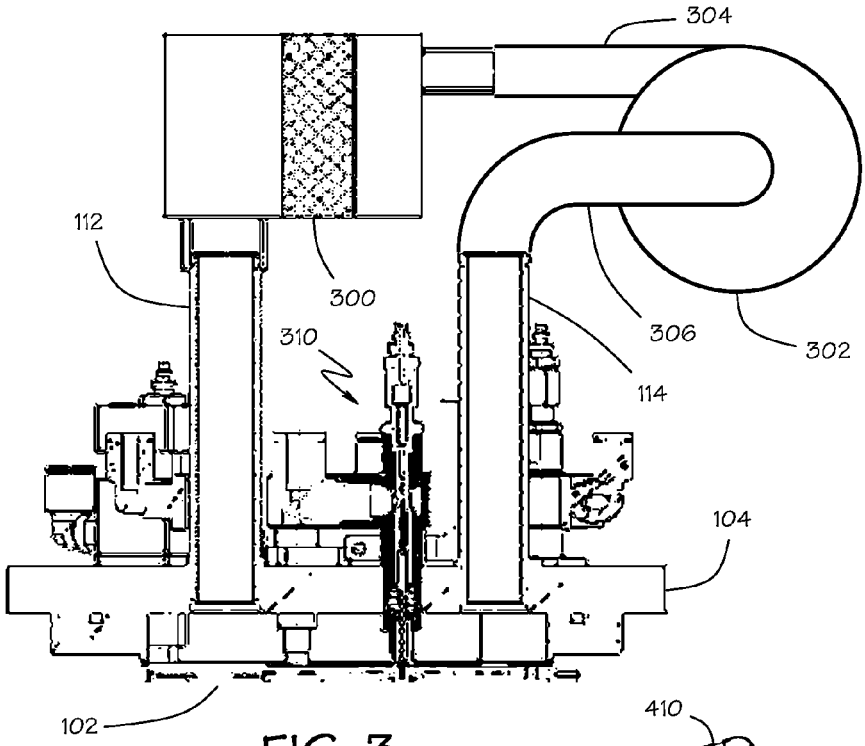
FIG. 3 is a detail from the side elevation of FIG. 2.

FIG. 3 shows a schematic cross-section of a portion of the HDA nest 104. A blower 302 may be coupled to at least one of the inlet port 112 and the exhaust port 114 to cause the gas to flow through the HDA 102. It will be appreciated that the gas may be pumped into the HDA, evacuated from the HDA, or recirculated through the HDA by the blower 302. The blower may be a centrifugal type blower, a positive displacement pump, or other type of device capable of causing the gas to flow through the HDA 102. The blower may move the gas at between approximately 500 and 800 liters per minute.

The exemplary embodiment shown in FIG. 3 shows a blower 302 that includes an outlet 304 coupled to the inlet port 112 and an inlet 306 coupled to the exhaust port 114 to recirculate the gas. As shown, a filter 300 may be coupled to the inlet port 112 to remove particles from the gas before it flows through the HDA 102. The filter 300 may be an ultra-low penetration air (ULPA) filter that is rated 99.999% efficient with particles 0.12 microns in diameter or larger.

In other embodiments, the gas may be provided by another source, rather than a blower. The gas may be provided by a utility supply or from compressed gas cylinders, perhaps at a higher pressure than could provided by a blower. In some embodiments, a vacuum inducing source may draw the gas through the HDA. A vacuum source may assist the flow of a gas provided at pressure to the inlet port or be the sole motivator for the flow of a gas provided at ambient pressure. Regardless of source, the gas may be air, nitrogen, or other gas.

Figure 5:
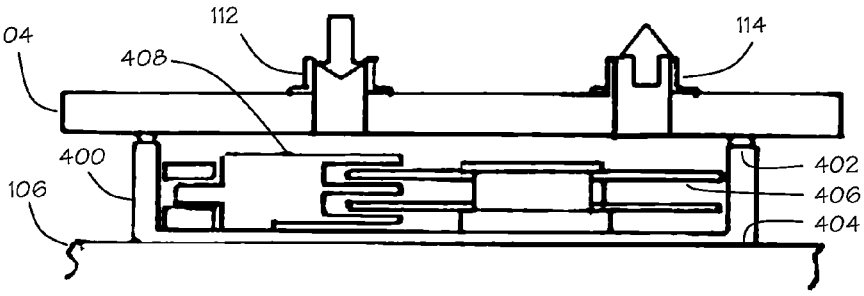
FIG. 5 is a schematic cross-section of a side elevation of an HDA and a portion of the machine shown in FIG. 1.

FIG. 5 shows a schematic cross-section of the HDA nest 104, 106 with an HDA frame 400 in the nest. As suggested by the figure, the inlet port 112 and the exhaust port 114 are located in the nest 104, 106 so that the gas will flow past substantially all the interior surfaces of the HDA during the cleaning process.

Referring to FIG. 2, a shock drive 116 is coupled to the HDA nest 104, 106 to deliver mechanical shocks to the HDA nest while the gas is flowing through the HDA 102. The HDA nest 104, 106 may be movable along an axis of the mechanical shocks delivered by the shock drive. The HDA nest may include an interlock between the upper portion 104 and the lower portion 106 of the nest to prevent relative motion between the portions as mechanical shocks are delivered to the nest. The shock drive may include a pneumatic cylinder to generate the shocks. The shock drive may deliver a shock to the HDA of between 50 g and 100 g.

The HDA 102 may include threaded holes. As shown in FIG. 4, these may include blind threaded holes 410 in the frame 400. The configuration of the threaded holes and the manufacturing processes for producing the holes may cause large numbers of particles to be located in the holes. The cleaning machine 100 may include one or more screw hole vacuums 310 coupled to the HDA nest 104, as shown in FIG. 3.

Figure 6A:
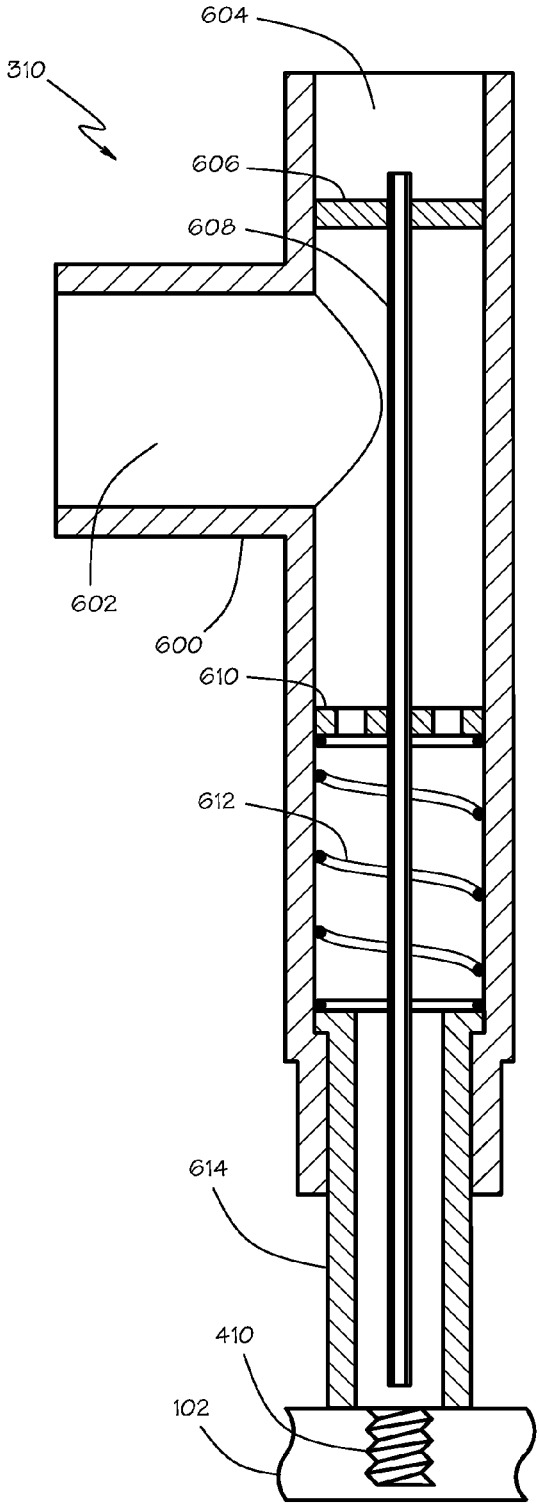
FIGS. 6A and 6B are schematic cross-sections of a side elevation of a screw hole vacuum portion of the machine shown in FIG. 1.
Figure 6B:
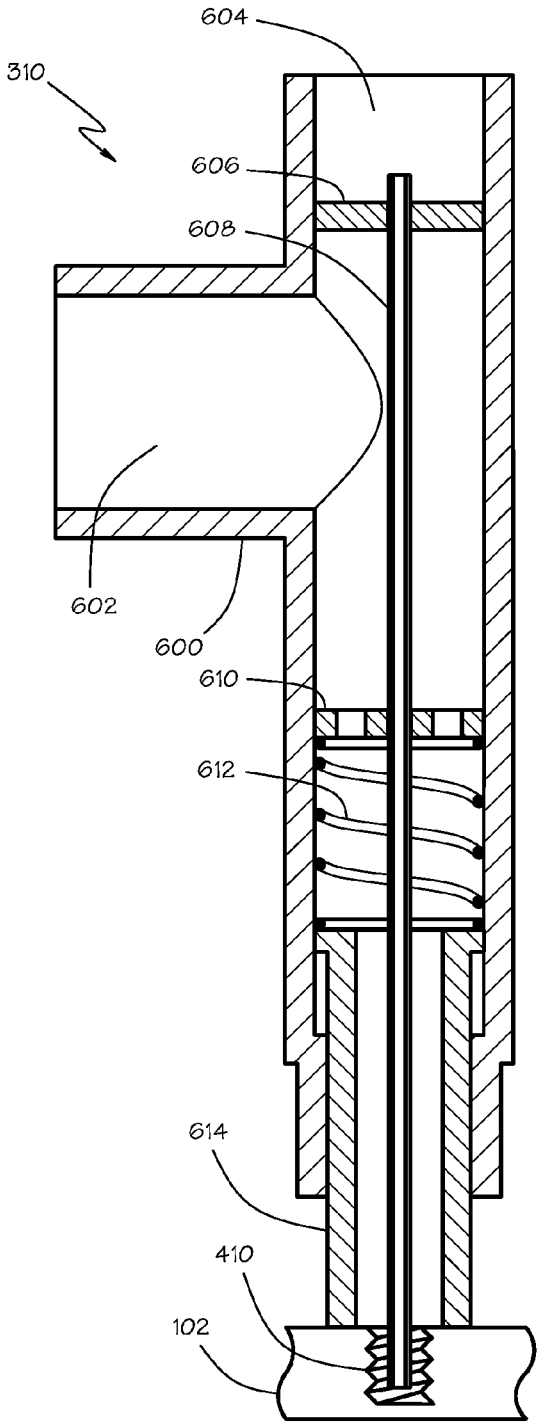

FIGS. 6A and 6B show a schematic cross-section of an exemplary screw hole vacuum 310. A blow tube 608 is coupled to a source of gas 604. A vacuum tube 614 is coupled to a vacuum inducing source 602. The vacuum tube 614 is substantially concentric with the blow tube 608. The outside diameter of the blow tube may be approximately 0.2 mm to 1 mm and the outside diameter of the vacuum tube may be approximately 2 mm to 8 mm.

The vacuum tube 614 and the blow tube 608 may be supported by a housing 600. While the housing 600 is shown as a single piece, it will be appreciated that it may be made in several pieces to facilitate assembly of the screw hole vacuum 310. The housing provides a connection 604 for a source of gas and a connection 602 for a vacuum inducing source. The two connections are separated, such as by the exemplary bulkhead 606, so that the gas can be delivered to a threaded hole 410 by the blow tube 608 while the vacuum tube 614 encapsulates the threaded hole with the vacuum inducing source. The blow tube 608 may pass through and be supported by the bulkhead 606 as shown.

The vacuum tube 614 may be retractable into the housing 600. In the exemplary configuration shown, the vacuum tube 614 slides within the housing 600. The vacuum tube 614 may be retained within the housing 600 at its fully extended position by cooperating shoulder portions on the housing and the vacuum tube as shown in FIG. 6A. A spring 612 may urge the vacuum tube 614 toward its fully extended position as shown in FIG. 6A. A perforated bulkhead 610 may support the spring 612 in the housing 600 while proving a connection between the vacuum inducing source 602 and the vacuum tube 614. The perforated bulkhead 610 may also support the blow tube 608, which may pass through the perforated bulkhead. In other embodiments, the spring 612 may be supported in the housing 600 by other means such as a shoulder in the housing.

As shown in FIG. 6B, the screw hole vacuum 310 may advance toward the HDA 102 after the vacuum tube 614 comes into contact with a surface of the HDA adjacent the threaded hole 410. The vacuum tube 614 may retract into the housing 600 against the urging of the spring 612. The blow tube 608 may extend into the threaded hole 410 as shown. Thus the vacuum tube 614 may be sealed against a surface of the HDA adjacent the threaded hole 410 and thereby encapsulate the hole and the blow tube 608 extending into the hole.

Gas may be delivered to the hole at between approximately 6 and 10 liters per minute to dislodge and entrain particles. The blower 302, shown in FIG. 3, may be the source of the gas. In other embodiments, the gas may be provided by another source, perhaps at a higher pressure than provided by the blower 302. The gas may be air, nitrogen, or other gas. The vacuum tube 614 receives the gas as it escapes from the threaded hole 410 with entrained particles.

The vacuum inducing source 602 draws off the gas and entrained particles. This may avoid introducing particles from the relatively contaminated holes into the balance of the HDA 102 during the cleaning process. In some embodiments, some or all of the threaded holes 410 may be outside the sealed cavity created by the sealing of the frame 400 in the HDA nest 104, 106. Thus the one or more screw hole vacuums 310 coupled to the HDA nest may provide cleaning for areas not cleaned by the gas that flows through the HDA 102 as described above. The shock drive 116 may or may not deliver mechanical shocks to the HDA nest 104, 106 during the screw hole vacuuming process.

Figure 8:
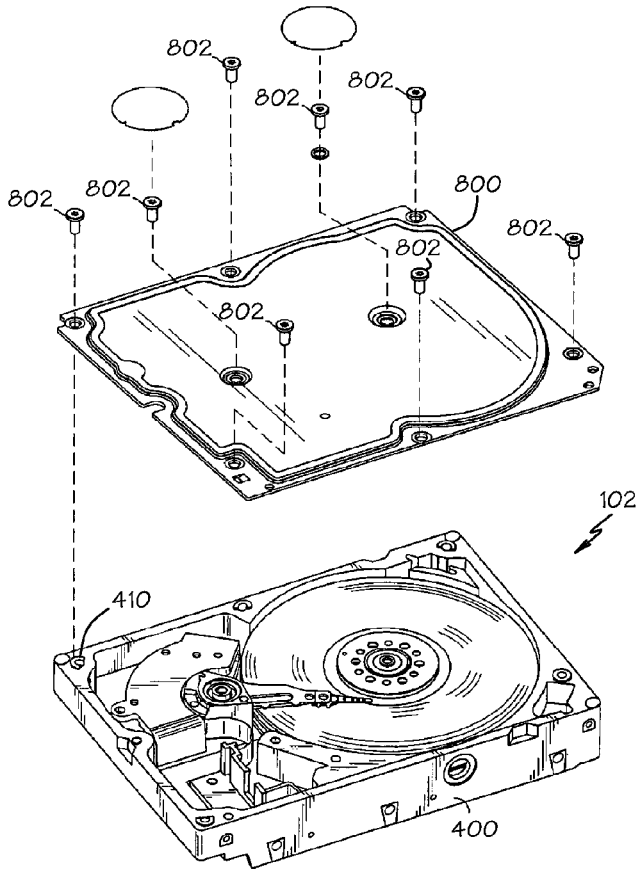
FIG. 8 is a pictorial view of an HDA being closed by a cover.

FIG. 8 shows the HDA 102 being sealed with a cover plate 800 after being cleaned using the above described HDA cleaning machine 100. The cover plate 800 may be secured to the HDA 102 using one or more screws 802 that may engage corresponding threaded holes 410 in the frame 400 of the HDA or elsewhere in the HDA. The cover plate may include a filtered vent that allows the air pressure in the HDA to be equalized with the ambient air pressure without introducing particular contamination into the HDA.

Figure 7:
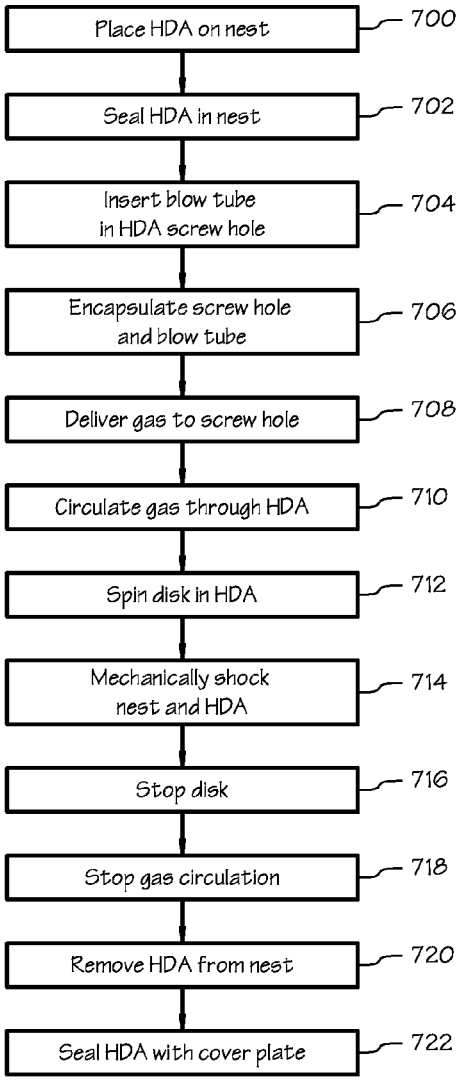
FIG. 7 is a flow chart of a method of cleaning an HDA using the machine shown in FIG. 1.

FIG. 7 is a flowchart for a method of cleaning a head-disk assembly (HDA) of a hard disk drive (HDD) using the above described HDA cleaning machine 100. The HDA is placed on a lower portion of an HDA nest 700. The HDA is sealed between an upper portion and the lower portion of the HDA nest 702.

A blow tube may be inserted into a screw hole in the HDA 704. The screw hole may be encapsulated with a vacuum tube that is substantially coaxial with and surrounds the blow tube 706. Gas is delivered to the screw hole by the blow tube 708. The blow tube may deliver gas at between approximately 6 and 10 liters per minute. The blow tube may deliver pulses of gas. The gas and entrained particles are removed from the screw hole by the vacuum tube. The blow tube may deliver gas to the screw hole 708 and then gas may be circulated through the HDA 710 as described above. In other embodiments, delivery of the gas by the blow tube may be concurrent with or following circulation of gas through the HDA.

A gas, such as air or nitrogen, is circulated through the HDA 710. The gas is received at an inlet port coupled to the HDA nest. The gas may pass through a filter before it is received at the inlet port. The gas is exhausted from an exhaust port coupled to the HDA nest to cause the gas to circulate through the HDA. The gas may be circulated at between approximately 500 and 800 liters per minute. The gas entrains particles that are within the HDA and sweeps them out of the HDA through the exhaust port.

The gas may be circulated through the HDA by a blower 302, as shown in

FIG. 3. In other embodiments, the gas may be provided by another source, such as a utility supply or from compressed gas cylinders, perhaps at a higher pressure than could provided by a blower. In some embodiments, a vacuum inducing source may draw the gas through the HDA. A vacuum source may assist the flow of a gas provided at pressure to the inlet port or be the sole motivator for the flow of a gas provided at ambient pressure.

A disk in the HDA may be spun at substantially the HDA's rated operating speed while the gas is circulated through the HDA to further increase the number of particles that are entrained in the circulating gas 712.

Mechanical shocks are delivered to the HDA nest and the HDA while the gas is circulating 714. Mechanical shocks may also be delivered to the HDA nest and the HDA while gas is delivered to the screw hole by the blow tube 708. The mechanical shocks may be approximately 5 to 15 shocks of between approximately 50 g and 100 g delivered at intervals of between approximately 0.5 and 2 seconds. The mechanical shocks dislodge some particles to increase the number of particles that are entrained in the circulating gas.

After the cleaning operations on the HDA are completed, the disk is stopped if it was spinning 716. Gas circulation is stopped 718. The HDA is removed from the HDA nest 720. The HDA is sealed with a cover plate to maintain the HDA in a clean condition 722.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A machine for cleaning a head-disk assembly (HDA) of a hard disk drive (HDD), the machine comprising:

an HDA nest having an upper portion and a lower portion;

at least one screw hole vacuum coupled to the HDA nest and configured to remove particles from a screw hole of the HDA, wherein the screw hole vacuum comprises a blow tube coupled to a source of gas and a vacuum tube coupled to a vacuum inducing source, the vacuum tube being substantially concentric with the blow tube;

an net port coupled to the HDA nest to receive a gas;

an exhaust port coupled to the HDA nest to exhaust the gas and entrained particles; and a shock drive coupled to the HDA nest to deliver mechanical shocks to the HDA nest.

2. The machine of claim 1, the machine further comprising a blower coupled to at least one of the net port and the exhaust port.

3. The machine of claim 2, wherein the blower includes an outlet coupled to the net port and an net coupled to the exhaust port.

4. The machine of claim 1, the machine further comprising a filter coupled to the net port.

5. The machine of claim 1, wherein the screw hole vacuum comprises:

the blow tube coupled to a source of gas via a first connection;

the vacuum tube coupled to a vacuum inducing source via a second connection; and a bulkhead separating the first and second connections.

6. The machine of claim 5, wherein the vacuum tube is retractable.

7. The machine of claim 5, wherein a blower is the source of the gas.

8. The machine of claim 1, wherein the HDA nest is movable along an axis of the mechanical shocks delivered by the shock drive and the HDA nest further includes an interlock between the upper portion and the lower portion.

9. The machine of claim 1, wherein the shock drive includes a pneumatic cylinder.

10. The machine of claim 1, wherein the HDA nest includes polyurethane seals.

11. The machine of claim 1, wherein the blow tube comprises an outside diameter of 0.2 mm to 1 mm.

12. The machine of claim 1, wherein the vacuum tube comprises an outside diameter of 2 mm to 8 mm.

13. The machine of claim 2, wherein the blower is configured to deliver approximately 6 to 10 liters of gas per minute to the blow tube.

14. The machine of claim 2, wherein the blower is configured to deliver pulses of gas.

15. The machine of claim 2, wherein the blower is configured to deliver nitrogen gas to the blow tube.

16. The machine of claim 2, wherein the blower is configured to deliver air to the blow tube.

17. The machine of claim 1, wherein a compressed gas cylinder is a source of the gas.

18. The machine of claim 1, wherein the shock drive is configured to deliver shocks of between approximately 50 g to 100 g.

19. The machine of claim 1, wherein the shock drive is configured to deliver shocks at intervals of between 0.5 to 2 seconds.

* * * * *